United States Patent [19]

Hannahs et al.

[11] 4,164,679

[45] Aug. 14, 1979

[54] STROBE LAMP SERIES TRIGGERING CIRCUIT

[75] Inventors: Arnold E. Hannahs, Springfield; Michael D. Patrick, Urbana, both of Ohio

[73] Assignee: Midland-Ross Corporation, Cleveland, Ohio

[21] Appl. No.: 881,587

[22] Filed: Feb. 27, 1978

[51] Int. Cl.[2] ..... H05B 41/30

[52] U.S. Cl. ..... 315/241 R; 315/239; 315/289; 315/278

[58] Field of Search ..... 315/241 R, 241 P, 241 S, 315/239, 278, 289; 320/1; 340/77, 105

[56] References Cited

U.S. PATENT DOCUMENTS

| | | | |
|---|---|---|---|
| 3,096,465 | 7/1963 | Moerkens | 315/278 |
| 3,297,912 | 1/1967 | Scheppe | 315/241 P X |

*Primary Examiner*—Eugene R. LaRoche
*Attorney, Agent, or Firm*—Biebel, French & Nauman

[57] ABSTRACT

A power supply and firing control circuit for a strobe lamp has a capacitor means for providing electrical power to the power electrodes of the strobe lamp for discharge through the strobe lamp. A transformer has a pair of secondary windings, one of which is connected to each of the power electrodes of the strobe lamp in series with the capacitor means. The firing pulses provided by the secondary windings of the transformer are of opposite electrical polarity. The absolute voltage differential between any portion of the circuit and ground potential will be minimized and energy losses thereby reduced. Additionally, the circuit provides substantial improvement in ionization effectiveness, thereby permitting the secondary turns of the transformer to be reduced in number and the transformer size and weight reduced correspondingly.

2 Claims, 3 Drawing Figures

STROBE LAMP SERIES TRIGGERING CIRCUIT

BACKGROUND OF THE INVENTION

The present invention relates to strobe lamp power supply and firing control circuitry and, more particularly, to a circuit providing for series firing of a strobe lamp at high altitudes with increased dependability.

Strobe lamps typically comprise a glass bulb in which are positioned two electrically isolated power electrodes. The bulb is filled with a gas, such as xenon which, when ionized, generates light of high intensity. A power supply provides an electrical potential across the power electrodes of the lamp, which potential is generally insufficient to cause the xenon to ionize. Once the lamp is fired, that is ionization is begun, however, the power supply will provide a large current flow between the power electrodes. A highly reflective metal light reflector is generally positioned adjacent the lamp to reflect the lamp light output in the desired direction.

Various firing techniques have in the past been used with strobe lamps. In a parallel trigger configuration, a high voltage pulse, on the order of 14,000 volts is supplied to the metal reflector. This trigger pulse will cause the gas in the bulb to ionize and the lamp power supply, typically including one or more capacitors, will then discharge through the lamp power electrodes to produce the strobe light flash.

It will be appreciated that raising the metallic reflector to an elevated potential of 14,000 volts will require that the reflector be thoroughly insulated from the surrounding strobe lamp structure which is grounded. While such insulation is possible at low altitudes, it will be appreciated that at high altitudes the insulating effect of the air between the reflector and adjacent grounded conductive parts of the lamp structure is reduced or eliminated such that unwanted arcing to ground from the reflector becomes virtually impossible to prevent.

In high altitude aviation and aerospace applications, it has been found necessary therefore to utilize a series triggering technique for triggering the strobe lamp. In a simple series triggering configuration, the reflector is grounded and plays no part in the triggering process. A trigger transformer has its secondary high voltage coil connected in series with the power supply for the lamp such that a 14,000 volt trigger pulse will be impressed upon the power supply output and applied to one of the power electrodes of the strobe lamp. Power supply voltage is typically on the order of 500 volts. While a simple series triggering technique was found to be operable, although undependable, at sea level, simple series triggering was not practical at high altitudes. It is thought that with one of the power electrodes of the strobe lamp being raised to 14,000 volts, too much leakage between the charged electrode and grounded structure, principally the grounded reflector, occurs. The energy which is leaked to the grounded reflector will not effectively ionize the xenon gas in the lamp. Additionally in a series triggering strobe lamp circuit, the high current discharge through the lamp must pass through the trigger transformer secondary windings. This results in a substantial increase in transformer size and weight which may be highly undesirable in an aviation application.

It is seen, therefore, that a need exists for a simple and reliable power supply and trigger circuit for a strobe lamp which will operate effectively at high altitudes and in which circuit component size and weight are minimized.

SUMMARY OF THE INVENTION

A strobe lamp and power supply arrangement includes a strobe lamp having a pair of power electrodes for electric discharge therebetween. A capacitor means has first and second power outputs and provides a source of electrical energy for discharge through the strobe lamp. A trigger means, connecting the capacitor means in series with the strobe lamp, provides a trigger pulse simultaneously to each of power electrodes of the strobe lamp, with the polarity of the trigger pulse applied one of the pair of power electrodes being opposite to that of the trigger pulse supplied to the other of the pair of power electrodes.

The trigger means may include a pair of trigger input terminals and a transformer having a primary winding which is connected to the trigger input terminals. The transformer also has a first secondary winding and a second secondary winding. Means are provided for connecting the first secondary winding between the first power output of the capacitor means and the one of the pair of power electrodes of the strobe lamp and for connecting the second secondary winding between the second power output of the capacitor means and the other of the power electrodes of the strobe lamp. The first and second secondary windings are connected such that the power electrodes of the strobe lamp will receive simultaneously firing pulses of opposite polarity from the first secondary winding and the second secondary winding when the primary winding is energized.

Accordingly, it is an object of the present invention to provide a strobe lamp triggering and power supply arrangement in which the strobe lamp is series triggered; to provide such an arrangement in which the dependability of the lamp operation is enhanced; to provide such an arrangement in which the size and weight of the triggering circuitry is minimized; and to provide such an arrangement in which the operating potentials of the lamp and associated circuitry are reduced such that lamp operation is enhanced.

Other objects and advantages of the present invention will be apparent from the following description, the accompanying drawings, and the appended claims.

DETAILED DESCRIPTION OF THE PREFERRED EMBODIMENT

Figure 1:
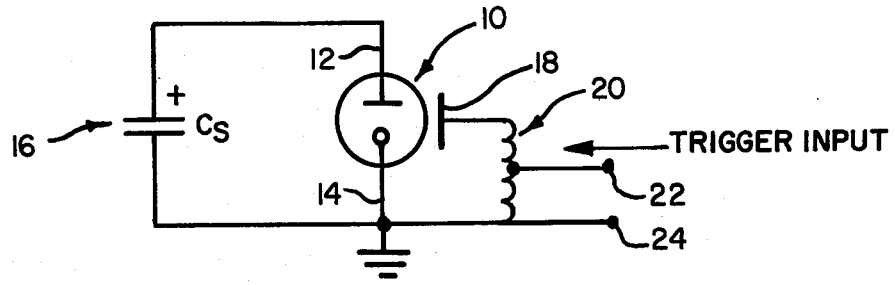
FIG-1 PRIOR ART
FIG. 1 is a schematic representation of a prior art parallel triggering circuit for a strobe lamp.

Reference is now made to FIG. 1 of the drawings in which a prior art triggering configuration is illustrated. A strobe lamp 10 includes a pair of power electrodes 12 and 14 to which is connected capacitor means 16. Capacitor means 16 provides a source of electrical energy for discharge through the strobe lamp 10 and may typically comprise a bank of capacitors which are charged to a potential of 500 volts. The capacitor means is charged after each delivery of energy to the strobe lamp by a D.C. power supply (not shown). The capacitor means is capable of delivering substantial electrical energy to the strobe lamp.

The glass bulb of lamp 10 is filled with a gas such as xenon which, when ionized by electrical discharge through the lamp, will provide a bright flash of light. Ionization of the xenon gas in the strobe lamp 10 is initiated by the application of a firing pulse to firing electrode 18, which may typically comprise the metallic light reflector of the lamp. Auto-transformer 20 will increase the voltage of the pulse applied to inputs 22 and 24 substantially such that approximately 14,000 volts will be applied as a trigger input to the electrode 18. Autotransformer 20 typically is of relatively small size and weight since the current applied to electrode 18 is minimal. As discussed previously, a parallel triggering configuration, as is shown in FIG. 1, becomes unreliable at extremely high altitudes due to leakage and arcing from the trigger electrode 18 to ground.

Figure 2:
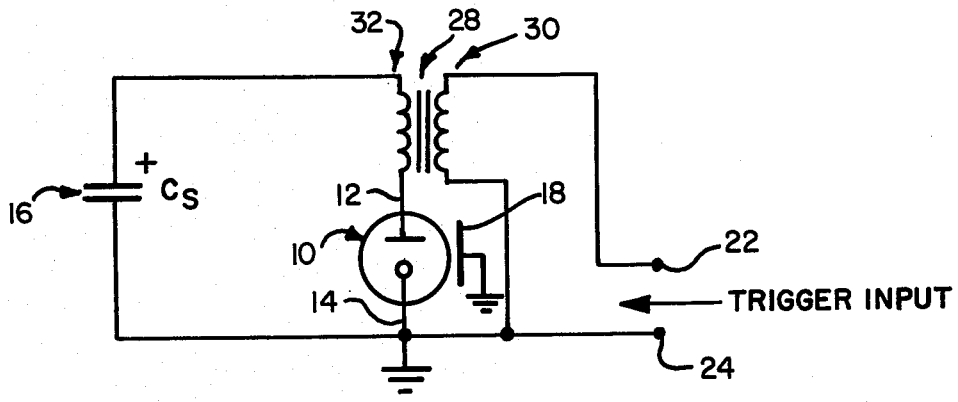
FIG-2 PRIOR ART
FIG. 2 is a schematic representation of a prior art series triggering circuit for a strobe lamp.

FIG. 2 illustrates a prior art series triggered strobe lamp circuit. The capacitor means 16 is connected to the strobe lamp 10. In the series triggered strobe lamp circuit of FIG. 2, however, transformer 28 is provided having a primary 30 connected to trigger input terminals 22 and 24 and a secondary winding 32 connected electrically in series with the capacitor means 16 and the lamp 10. The power supply capacitor 16 provides approximately 500 volts across the power terminals 12 and 14 of the strobe lamp 10.

In order to fire the lamp 10, it is necessary to impress an extremely high voltage, approximately 14,000 volts, on the power electrode 12 in order to initiate ionization of the gas in the lamp 10. It will be appreciated that the pulse applied to trigger inputs 22 and 24, on the order of several hundred volts, will necessarily have to be increased substantially by the transformer 28 in order to produce such a high potential at power electrode 12. A large number of turns will, therefore, be required in the secondary 32 of the transformer. Since the secondary also will carry the substantial current provided to the power electrodes 12 and 14 by the capacitor means 16 during each firing of the lamp, the secondary must necessarily be wound of relatively heavy gauge wire. The transformer 28, therefore, will be relatively large and heavy in comparison to the autotransformer used in a parallel triggering arrangement as shown in FIG. 1.

As discussed previously, the series triggering technique shown in FIG. 2 was not found to be operable at high altitudes. It is thought that substantial leakage between the electrode 12 and the grounded structure of the lamp, including the lamp reflector which is adjacent the outside surface of the glass tube, results in a substantial reduction in ionization effectiveness and causes the lamp to fire undependably at high altitudes.

Figure 3:
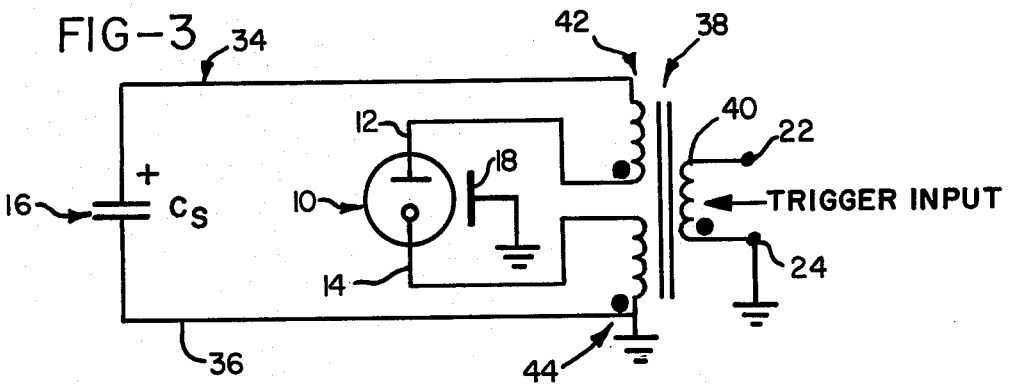
FIG. 3 is a schematic representation of the improved strobe lamp series triggering circuit of the present invention.

Reference is now made to FIG. 3 which illustrates the improved modified series triggering circuit of the present invention. As with the prior art strobe lamp circuits illustrated in FIGS. 1 and 2, the circuit of FIG. 3 includes a strobe lamp 10 having a pair of power electrodes 12 and 14. A capacitor means 16 provides a source of electrical energy for discharge through the strobe lamp 10. The capacitor means may typically comprise a bank of capacitors, represented here diagrammatically by single capacitance, connected in parallel and an arrangement for charging the capacitors (not shown) between each strobe lamp firing cycle. The capacitor means 16 has a first power output 34 and a second power output 36.

A trigger means, including transformer 38 connecting the capacitor means 16 in series with the strobe lamp 10, provides a triggering pulse simultaneously to each of the power electrodes 12 and 14 of the strobe lamp. The polarity of the trigger pulse applied to one of the pair of power electrodes is opposite to the polarity of the trigger pulse applied to the other of the pair of power electrodes. Thus, for example, the power electrode 12 may receive a trigger pulse of approximately +3000 volts with respect to ground while the other power electrode 14 receives a trigger pulse simultaneously of approximately −3000 volts with respect to ground.

The net result is that a firing trigger voltage differential between electrodes 12 and 14 of approximately 6000 volts will be provided, while neither of the electrodes experiences a trigger pulse potential of greater than one-half that amount with respect to the grounded lamp structure. Thus the leakage to grounded lamp structure, such as the grounded reflector 18, which was experienced with prior art series trigger configurations, will be reduced substantially and more effective ionization will be provided. It has been determined, as mentioned previously, that the increased ionization effectiveness of the circuit of FIG. 3 permits a substantial reduction in the trigger pulse which must be impressed across the power electrodes 12 and 14 in order for ionization to occur. This reduction in the required trigger pulse amplitude results in the transformer 38 having fewer turns in its secondary winding. Transformer 38 is, therefore, substantially reduced in size and weight.

As shown in FIG. 3, transformer 38 has a primary winding 40 which is connected electrically to the trigger input terminals 22 and 24. Transformer 38 additionally includes a first secondary winding 42 and a second secondary winding 44. The first secondary winding is connected between the first power output 34 of the capacitor means 16 and the power electrode 12 of the strobe lamp 10. In like manner, the second secondary winding 44 is connected between the second power output 36 of the capacitor means 16 and the power electrode 14 of strobe lamp 10. The phase relationship between secondary winding 42 and secondary winding 44 is as indicated to produce simultaneous, opposite-going trigger pulses applied to the power electrodes 12 and 14.

The circuit of FIG. 3 provides substantial advantages over prior art circuits. As mentioned previously, a lower trigger potential is applied to the power electrodes of the strobe lamp than is required with other circuit configurations. This results in substantially reduced electromagnetic radiation and in reduction of the insulation and dielectric problems which are experienced with other triggering configurations. Additionally, it will be appreciated that since a lower trigger potential level is required and the number of secondary winding turns correspondingly reduced, the weight and size of the overall strobe lamp circuit will be substantially reduced.

While the form of apparatus herein described constitutes a preferred embodiment of the invention, it is to be understood that the invention is not limited to this precise form of apparatus, and that changes may be made therein without departing from the scope of the invention.

What is claimed is:

1. A strobe lamp triggering and power supply arrangement for providing dependable strobe light output, comprising:

a strobe lamp having a pair of power electrodes for electric discharge therebetween to produce a strobe light output, capacitor means, having a first and second power output, for providing a source of electrical energy for discharge through said strobe lamp, and trigger means, connecting said capacitor means in series with said strobe lamp, for providing a trigger pulse simultaneously to each of said power electrodes of said strobe lamp, the polarity of the trigger pulse applied to one of said pair of power electrodes being opposite to the polarity of the trigger pulse applied to the other of said pair of power electrodes, said trigger means including a pair of trigger input terminals, a transformer having a primary winding, a first secondary winding and a second secondary winding, said primary winding being connected to said pair of trigger input terminals, and means for connecting said first secondary winding between said first power output of said capacitor means and one of said pair of power electrodes of said strobe lamp, and for connecting said second secondary winding between said second power output of said capacitor means and the other of said power electrodes of said strobe lamp, said first and second secondary windings being connected such that said power electrodes of said strobe lamp will each receive simultaneously firing pulses of opposite polarity from said first secondary winding and said second secondary winding when said primary winding is energized, whereby said strobe lamp will fire upon application of said trigger pulses to said power electrodes and said capacitor means will provide electrical energy for discharge through said lamp.

2. A power supply and firing control circuit for a strobe lamp having first and second power electrodes comprising:

a capacitor means for providing electrical power for discharge through the strobe lamp, said capacitor means having first and second power outputs, transformer means having a primary winding for receiving a trigger input and having a pair of secondary windings, means for connecting one of said pair of secondary windings between the first power electrode of the lamp and said first power output of said capacitor means, and for connecting the other of said pair of secondary windings between the second power electrode of the lamp and said second power output of said capacitor means, such that the power electrodes of the lamp will receive firing pulses from said secondary windings of said transformer which are of opposite electrical polarity, whereby the absolute voltage differential between any portion of the circuit and ground potential will be minimized and energy losses thereby reduced.

* * * * *